United States Patent [19]

Palmier et al.

[11] Patent Number: 4,686,501

[45] Date of Patent: Aug. 11, 1987

[54] ELECTROMAGNETIC ACTUATOR COMPRISING AT LEAST TWO DISTINCT MAGNETIC CIRCUITS

[75] Inventors: René G. Palmier; Pierre P. Perrier; Sing K. Phounsombath, all of Ramonville-Saint-Agne, France

[73] Assignee: Equipements Automobiles Marchal, Issy-les-Moulineaux, France

[21] Appl. No.: 660,003

[22] Filed: Oct. 11, 1984

[30] Foreign Application Priority Data

Oct. 14, 1983 [FR] France ..... 83 16443
Feb. 7, 1984 [FR] France ..... 84 01830

[51] Int. Cl.[4] ..... H01F 7/08
[52] U.S. Cl. ..... 335/256; 335/258
[58] Field of Search ..... 335/255, 256, 258

[56] References Cited

U.S. PATENT DOCUMENTS

| | | | |
|---|---|---|---|
| 521,269 | 6/1894 | Michl | 335/255 |
| 2,348,556 | 5/1944 | Matthias | 335/255 X |
| 2,769,943 | 11/1956 | Matthews | 335/256 |
| 3,241,006 | 3/1966 | Boyko | 335/273 |
| 3,814,376 | 6/1974 | Reinicke | 335/234 |
| 3,946,851 | 3/1976 | Cestrieres et al. | 335/256 X |
| 4,097,833 | 6/1978 | Myers | 335/256 |

FOREIGN PATENT DOCUMENTS

| | | | |
|---|---|---|---|
| 455645 | 4/1949 | Canada | 335/258 |
| 1540471 | 1/1970 | Fed. Rep. of Germany | 335/255 |
| 2906799 | 2/1979 | Fed. Rep. of Germany | 335/266 |
| 381321 | 6/1960 | Switzerland | 335/256 |
| 591040 | 4/1945 | United Kingdom | 335/279 |
| 1228612 | 4/1971 | United Kingdom | 335/255 |
| 1559373 | 1/1980 | United Kingdom | 335/256 |
| 2104730 | 3/1983 | United Kingdom | 335/230 |

OTHER PUBLICATIONS

As. Patents abstracts of Japan, vol. 5, No. 181 (E-83)(855) 20 Nov. 81, Japanese patent application 56-108-208, 8/27/1981.

*Primary Examiner*—George Harris
*Attorney, Agent, or Firm*—Brisebois & Kruger

[57] ABSTRACT

An electromagnetic actuator comprises two armatures which are relatively movable to define a stroke and which form a main magnetic circuit the reluctance of which is variable between the ends of the stroke. A secondary magnetic circuit is formed between the armatures and its reluctance is also variable between the ends of the stroke, the variation being different to that of the first circuit to allow the relationship between the force of the actuator and the stroke position to be trailored to suit different requirements.

7 Claims, 8 Drawing Figures

ELECTROMAGNETIC ACTUATOR COMPRISING AT LEAST TWO DISTINCT MAGNETIC CIRCUITS

INTRODUCTION

The present invention relates to an electromagnetic actuator comprising two armatures capable of relative movement defining a stroke.

Such an actuator allows at least one moving part to be controlled by means of the electric supply from at least one coil generating an electromagnetic force. The force with which control is effected along the stroke is an essential characteristic of such an actuator.

BACKGROUND OF THE INVENTION

An electromagnetic actuator is known, comprising two armatures and a magnetic circuit of which the reluctance is variable during operation between a minimum value attained at one end of the stroke and a maximum value attained at the other end of said stroke. In such an actuator, the electromagnetic control force increases continuously when passing from the end of the stroke where the reluctance of the magnetic circuit is maximum to the end where the reluctance is minimum; the moving part by means of which the control is transmitted is generally subject to a slight return force; it is thus observed that the control force available varies along the stroke in a continuous manner on which it is impossible to act. The value of the force available obviously depends on the electromagnetic coil forming part of the actuator and the idea has already been proposed of arranging, inside the same actuator, several distinct coils of which the supplies are arranged according to the position of the moving part of the actuator; in particular, the idea has been proposed of using two coils which act simultaneously to initiate travel of the moving element of the actuator but of which one remains supplied when the moving element reaches its position where the reluctance of the magnetic circuit is at a minimum. Such an actuator can be used, in particular, for controlling the travel of the starter pinion connected to the crown of a car starter motor.

However, electromagnetic actuators of known type have the basic disadvantage of delivering an available control force which varies in an unalterable continuous and defined manner along the stroke of the moving part of the actuator. This continuous variation may not be troublesome for certain applications but it constitutes an obstacle in other applications, particularly if an electromagnetic actuator is to be used for controlling mechanical engagement and disengagement of a motor vehicle clutch. In fact, it is known that the effort to be applied to the control diaphragm of the clutch in such a case is variable along the stroke according to a so-called "saddle-back" curve; this curve giving the force F as a function of the stroke C has a decreasing zone situated between two increasing zones. In other applications of actuators, it may be particularly worthwhile to keep the available control force constant over a large proportion of the stroke. It has thus been found desirable to be able to act on the form of the curve representing the variation in the control force supplied by the actuator as a function of the stroke of the moving element of the actuator.

SUMMARY OF THE INVENTION

The object of the present invention is to provide an electromagnetic actuator of which the design allows alteration of the curve representing the variations in the force as a function of the stroke and of which the design allows, in particular, the obtaining either of a constant force or of a "saddle-back" shaped curve. To this end, it is proposed that a plurality of magnetic circuits of variable reluctance be arranged in the electromagnetic actuator according to the invention, the different circuits having variations of reluctance which are staggered during the stroke of the moving element of the actuator. It is observed that, under these conditions, superimposition of the effects of the various magnetic circuits allow alteration of the shape of the force variation curve right along the stroke. The basic principle of the invention, therefore, is to superimpose the effects of a plurality of magnetic circuits of which the reluctances can vary in the same direction or in different directions between a minimum value and a maximum value, the zones of variation of the reluctances of the various magnetic circuits being staggered relative to each other along the stroke of the moving element of the actuator so that, during the travel of this moving element over time, the variations of reluctance of the various circuits occur at least in part at different moments.

The present invention provides an electromagnetic actuator comprising two armatures capable of relative movement defining a stroke, and a main magnetic circuit of which the reluctance is variable during operation between a minimum value attained at the other end of the stroke, characterised in that it comprises at least one secondary magnetic circuit of which the reluctance is variable during operation between a minimum and a maximum, this variation being staggered during the stroke relative to that of the reluctance of the main magnetic circuit.

In a preferred embodiment, the variation in reluctance of the main and secondary magnetic circuits is obtained by varying the air gap during the relative movement of the armatures of the actuator; the variations of reluctance of the main and secondary circuits during one operating stroke of the actuator are monotonic variations in the same direction.

The actuator according to the invention can advantageously comprise an external ferromagnetic armature which surrounds an internal ferromagnetic armature, at least two coil elements being borne by one of the armatures and being arranged in the annular volume between the two armatures, the armature bearing the coil elements being connected to at least one ferromagnetic separator which is arranged between two coil elements and which defines a secondary magnetic circuit with the armatures; the external armature can have a cylindrical shape and can comprise a base, the internal armature being arranged substantially along the axis of the external armature, the air gap of the main magnetic circuit being constituted by two portions, one constant portion distributed cylindrically between the two armatures and a variable portion arranged between the internal armature and the base of the external armature; in this case, the separator can be arranged radially at right angles to the variable portion of the air gap of the main magnetic circuit, the secondary magnetic circuit comprising an air gap constituted by a constant portion and a variable portion.

In a preferred embodiment, the separator has the shape of an annular washer of constant thickness e; when the air gap of the main magnetic circuit is at a minimum, the variable portion of the air gap of the secondary magnetic circuit is constituted overall by a cylindrical space of constant width E defined by the separator between the two armatures. In a variation, the cylindrical space defined by the separator between the two armatures is constituted by a single cylindrical ring of width E arranged, for example, between the internal armature and the separator. In another variation, the cylindrical space defined by the separator between the two armatures is constituted by a plurality of cylindrical rings, the sum of whose widths, measured radially, is equal to E.

According to an interesting embodiment, the coil elements are arranged inside the external armature. The external armature is fixed whereas the internal armature constitutes a moving plunger. In a variation, the coil elements arranged on either side of the separator constitute two distinct coils. In another variation, the coil elements arranged on either side of the separator form two portions of the same coil.

If the effort supplied by the moving part of the actuator is to vary as a function of the stroke along a so-called "saddle-back" curve it has been found that, for an actuator design constituted by a cylindrical external armature and an internal armature arranged along the axis of the external armature, the external armature bearing internally two coil elements separated by a separator constituted by an annular radial washer borne by the external armature, certain relationships between the various dimensional parameters of the design should be adopted. To define these relationships, the constant thickness of the cylindrical lateral wall of the external armature is designated by H, the mean diameter of said cylindrical wall of the external armature by $\phi_e$ the diameter of the internal rim of the separator by $\phi_i$, the thickness of the separator measured along the axis of the external armature by e, the width of the minimum air gap existing between the separator and the internal armature by E, the stroke between the positions where the air gap of the main magnetic circuit is at a maximum or a minimum by D, the distance between the separator and the constant portion of the air gap of the main magnetic circuit by x, and the distance between the front face of the internal armature opposite the base of the external armature and the constant portion of the air gap in the main magnetic circuit when said air gap is at a maximum by $x_o$. Three equations are thus defined below:

$$\lambda_1 = e\phi/_i H\phi_e;$$

$$\lambda_2 = E/D \text{ and}$$

$$\lambda_3 = x - x_o/D$$

It is observed that if the control force is to vary as a function of the stroke along a "saddle-back" curve, and providing all other things are equal, the ratios $\lambda_1$, $\lambda_2$, $\lambda_3$ defined above should be selected in the following manner:

$$0.18 < \lambda_1 < 0.45;$$

$$0.04 < \lambda_2 < 0.17;$$

$\lambda_3$: approximately 0.37.

On the other hand, if the control force of the actuator is to remain substantially constant right along the stroke, the following values should be selected:

$$0.08 < \lambda_1 < 0.18;$$

$$0.17 < \lambda_2 < 0.43;$$

$$0.15 < \lambda_3 < 0.60.$$

The particular ranges of the ratios $\lambda_1$, $\lambda_2$, $\lambda_3$ given above have been defined by study of the design shown in FIG. 1.

A further object of the present invention is to provide a particularly simple and economical solution for the production of such a secondary magnetic circuit, particularly with regard to its installation.

According to another aspect of the invention, an electromagnetic actuator of the type defined above and which comprises at least one secondary magnetic circuit of which the reluctance is variable during operation between a minimum and maximum, this variation being staggered during the stroke relative to that of the reluctance of the main magnetic circuit, this variation in the reluctance of the main and secondary magnetic circuits being obtained by varying air gaps during the relative movement of the armatures of the actuator, said actuator comprising an external ferromagnetic armature which surrounds an internal ferromagnetic armature, at least one coil being borne by the external armature and being arranged in the annular volume between the two armatures, is characterised by the fact that the secondary magnetic circuit comprises at least one ferromagnetic element of annular shape extending parallel to the axis of the coil and housed in the internal volume of this coil.

This ferromagnetic element of annular shape can be constituted by a sleeve or ring, in particular a cylindrical sleeve or ring, or by a sleeve having a truncated external radial surface.

In this case, the sleeve can be held simply by the turns of the coil which surrounds this sleeve and is housed in the external armature. This coil can be formed by a single winding or by two or more juxtaposed windings. In the case of several juxtaposed windings, the number of ampere-turns of each winding is not imposed by the axial position of the sleeve.

The annular ferromagnetic element can comprise a sleeve integral with a circular crown extending radially up to the external ferromagnetic armature, the coil thus comprising at least two windings provided on either side of this crown. The section through a diametral plane of the entire element can have the shape substantially of an L or a T.

By altering the axial length of the sleeve, its radial thickness and its position in the axial direction relative to the external armature, it is possible to modify the curve of variation in the control force supplied by the actuator as a function of the stroke.

BRIEF DESCRIPTION OF THE DRAWINGS

Apart from the arrangements described above, the invention includes within its scope various other arrangements some of which will be dealt with in more detail below. The invention will be further described by way of example only with reference to the accompanying drawings, in which.

DESCRIPTION OF THE PREFERRED EMBODIMENTS

Figure 1:
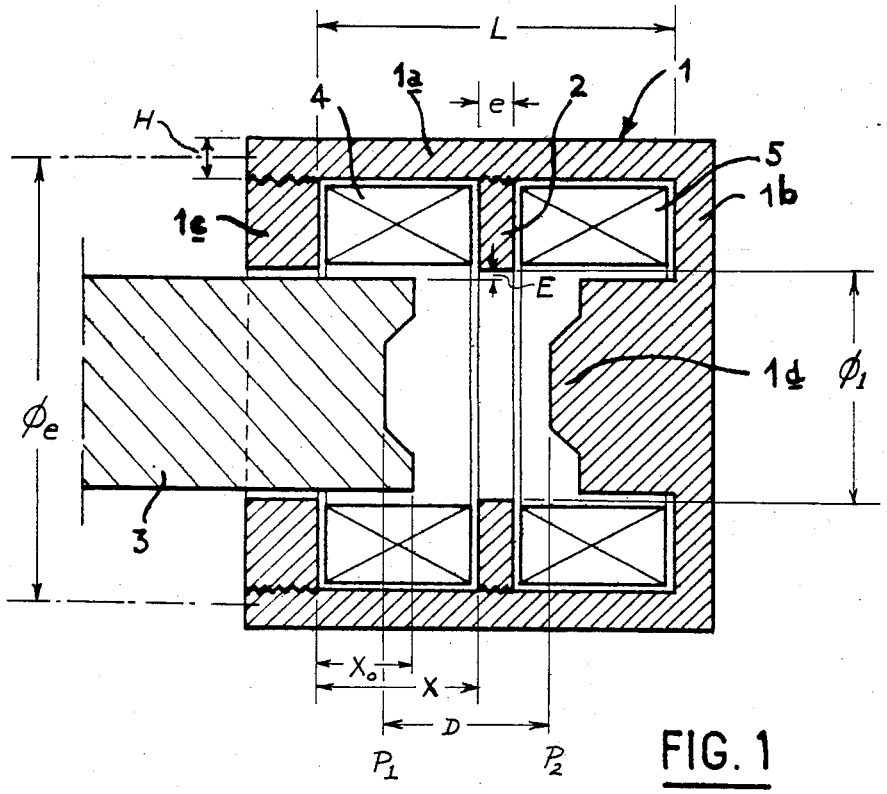
FIG. 1 shows an electromagnetic actuator according to the invention schematically in an axial section.

With reference to the drawings and in particular to FIG. 1 it is seen that the electromagnetic actuator according to the invention comprises an external armature 1 of general cylindrical shape. The external armature 1 comprises a cylindrical lateral wall 1*a*, which is closed at one end by a base 1*b* and at its other end by an annular flange 1*c*.

Figure 2:
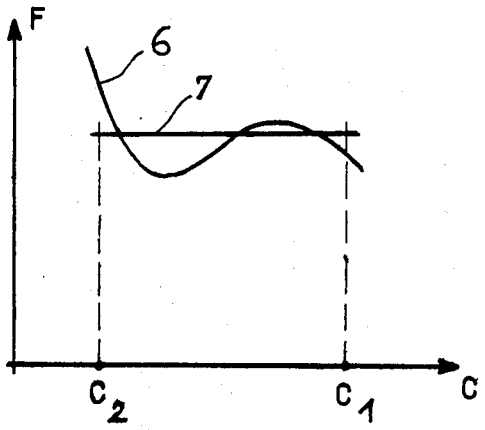
FIG. 2 shows two particular curves of variation in the control force supplied by an actuator of type illustrated in FIG. 1, one of the curves corresponding to the case in which a constant force is obtained right along the stroke whereas the other curve corresponds to the case where the choice of parameters leads to a "saddle-back" curve.

In its median zone, the cylindrical lateral wall 1*a* bears a separator 2 which has the shape of an annular washer projecting towards the axis of the external armature. In the central zone of the base 1*b* there has been placed a seat 1*d* which projects towards the interior of the external armature in the direction of the separator 2. The frontal form of the seat 1*d* corresponds to the frontal form of the moving armature 3 of the actuator. The moving armature 3 is a moving plunger constituted by a cylindrical shaft which is capable of sliding relative to the external armature 1 between a position $P_1$ corresponding to the position shown in FIG. 1 and a position $P_2$ in which the frontal face of the internal armature 3 is in contact with the frontal face of the seat 1*d*. The armatures 1 and 3 and the separator 2 are produced from a ferromagnetic material, for example, from steel. In FIG. 2, the positions $P_1$ and $P_2$ have been labelled and define the ends of the stroke during which the variation in the control force supplied by the actuator is being studied. The plunger which constitutes the internal armature 3 is subjected to the action of a return spring, not shown in the drawings, this return spring acting in the direction opposite to the electromagnetic force and being intended merely to bring the plunger 3 back towards the ends of its stroke.

The electromagnetic actuator just described comprises two coil elements constituted by two distinct coils 4 and 5. The coil 4 is arranged between the flange 1*c* and the separator 2. It comprises 120 turns of a 1.06 mm diameter copper wire and it is supplied from a 12 volt battery with a current of 23.5 amperes. The coil 5 is arranged between the separator 2 and the base 1*b*. It is constituted by 120 turns of a 0.6 mm diameter copper wire and it is supplied from a 12 volt battery with a current of 6.5 amperes. For installation of the coils 5 and 4, the separator 2 and the flange 1*c* are produced in the form of annular washers which are screwed inside the lateral cylindrical wall 1*a*. The coil 5 is positioned first of all and then the separator 2, by screwing, then the coil 4 and finally, by screwing, the annular flange 1*c*.

The following dimensions have been adopted for the device under consideration: the thickness of the flange 1*c* measured along the axis of the armature is 7.6 mm and the air gap between this flange and the internal armature 3 is 0.5 mm; the diameter of the internal armature 3 is 25 mm; in the position $C_1$ shown in FIG. 1 the internal armature 3 has a frontal face which, along its axis, is at a distance D=12 mm from the front face of the seat 1*d* facing it. The distance between the internal face of the flange 1*c* and the front face of the seat 1*d*, measured along the axis of the external armature 1 is 20.9 mm. The internal diameter of the cylindrical wall 1*a* is 48.5 mm and its external diameter is 54 mm. The distance L between the base 1*b* and the internal face of the flange 1*c* is 26.8 mm, the thickness of the base 1*b* is 2.8 mm. The thickness of the separator 2 measured along the axis of the external armature has been designated by e; the distance between the internal rim of the separator 2 and the internal armature 3 when this armature 3 is positioned at right angles to the separator 2 by E; the distance between the separator 2 and the internal face of the flange 1*c* by x; the distance between the internal wall of the flange 1*c* and front face of the internal armature 3 at the periphery thereof by $x_0$; the mean diameter of the lateral cylindrical wall 1*a* by $\phi_e$; the diameter of the internal rim of the separator 2 by $\phi_1$ and the thickness of the lateral wall 1*a* by H.

In the electromagnetic actuator just described the main magnetic circuit is constituted by the path of flux which does not pass through the separator 2, that is to say on leaving the internal armature 3 in the following sequence: plunger 3, constant annular air gap of 0.5 mm existing between the plunger 3 and the annular flange 1*c*, annular flange 1*c*, lateral cylindrical wall 1*a*, base 1*b*, seat 1*d*, variable air gap between the seat 1*d* and the front face of the plunger 3. In this main magnetic circuit, there is a constant portion of the main air gap between the plunger 3 and the flange 1*c* and a variable portion of the main air gap between the seat 1*d* and the plunger 3. The secondary magnetic circuit passes through the separator 2 and consequently corresponds to the following flux path: plunger 3, constant annular air gap of 0.5 mm between the plunger 3 and the annular flange 1*c*, annular flange 1*c*, lateral cylindrical wall 1*a*, separator 2, variable air gap between the separator 2 and the plunger 3. It is to be observed that the secondary magnetic circuit comprises a constant portion of secondary air gap between the plunger 3 and the flange 1*c* and a variable portion of secondary air gap between the separator 2 and the plunger 3. If the following dimensions are adopted in the design defined above:

$$1\ \text{mm} < e < 2.5\ \text{mm},$$

$$0.5\ \text{mm} < E < 2\ \text{mm},$$

$$X = 0.5$$

it is observed that the curve for the variation in the force obtained on the plunger 3 as a function of the stroke, when the two coils 4 and 5 are supplied simultaneously, is a "saddle-back" curve like the one designated by 6 in FIG. 2; in this Figure, the force available on the plunger 3 has been designated by F and has been plotted as the ordinate. The stroke of the plunger 3 has been designated by C and has been plotted as the abscissa. The point $C_1$ corresponds to the position of $P_1$ shown in FIG. 1 where the reluctance of the main and secondary magnetic circuits is at a maximum, whereas the point $C_2$ corresponds to an intermediate position close to the position $P_2$ in which the plunger 3 comes into contact by its front face with the seat 1*d*. The reason for obtaining a stress curve like the curve 6 is that the actuator thus defined can easily be used for controlling a mechanical starter motor of a car.

If the design of actuator described above is to be used for obtaining a control force which is constant at least over a large proportion of the stroke and which is consequently represented by the curve 7 in FIG. 2, it has been found that the following values should be selected:

$$0.5 \text{ mm} < e < 1 \text{ mm};$$

$$2 \text{ mm} < E < 5 \text{ mm};$$

$$0.4 < X/L < 0.6.$$

It has been established from the experimental data given above that, for the curve forms 6 and 7, zones of variations could be defined for the following dimensionless ratios:

$$\lambda_1 = e\phi_i / H\phi_e;$$

$$\lambda_2 = E/D;$$

$$\lambda_3 = x - x_0/D$$

To obtain a curve of type 6, the following values should be selected, all other things remaining equal:

$$0.18 < \lambda_1 < 0.45;$$

$$0.04 < \lambda_2 < 0.17;$$

$\lambda_3$: approximately 0.37.

To obtain a curve of type 7, it is necessary to select the following values, all other things being equal:

$$0.08 < \lambda_1 < 0.18;$$

$$0.17 < \lambda_2 < 0.43;$$

$$0.15 < \lambda_3 < 0.60.$$

Figure 3:
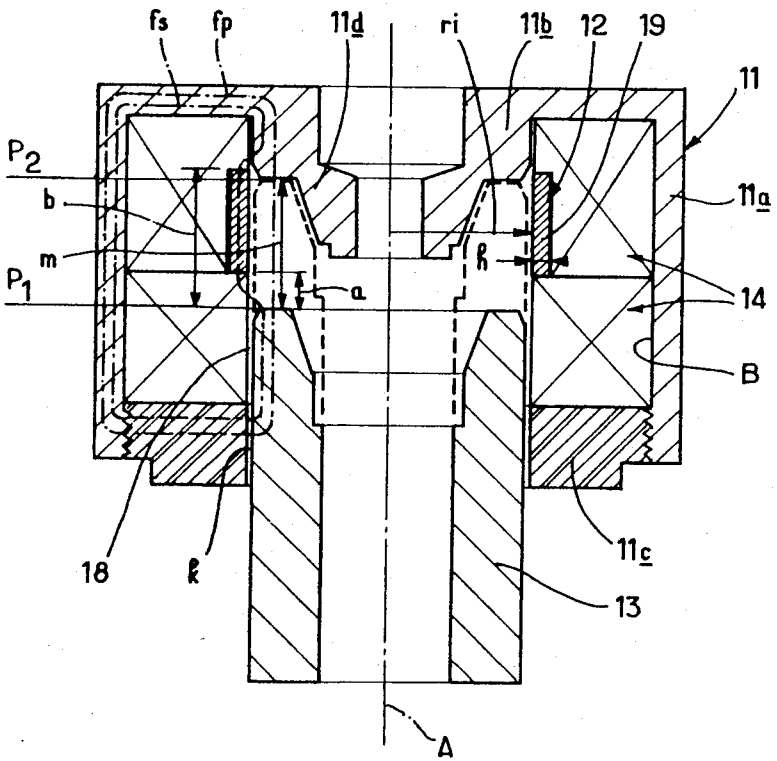
FIG. 3 shows a modification of the electromagnetic actuator of FIG. 1 schematically in an axial section.

FIG. 3 shows an electromagnetic actuator comprising an external ferromagnetic armature 11 of general cylindrical shape. The external armature 11 comprises a lateral cylindrical wall 11*a* which is closed at one end by a base 11*b* and of its other end by an annular flange 11*c*. In the central zone of the base 11*b* there is provided a seat 11*d* which projects axially towards the interior of the external armature. The flange 11*c* can be screwed into the wall 11*a*.

This external armature 11 surrounds an internal ferromagnetic armature 13 which can have the shape of a hollow cylinder and which constitutes the moving armature 13 of the actuator. The frontal form of the seat 11*d* corresponds to that of the frontal end of the armature 13 turned towards the seat 11*d*. Thus, at the end of its stroke, when the armature 13 arrives against the seat 11*d*, the seat engages in said armature.

The internal armature 13 or moving plunger is subjected to the action of a return spring (not shown in the drawings) this spring acting in the direction opposite to the electromagnetic forces and, in the drawing in FIG. 3, having a tendency to displace the armature 13 from the seat 11*d* and to return this armature into a rest position $P_1$ shown in solid lines in FIG. 3. The operating position $P_2$ of the armature 13 corresponds to the position in which this armature abuts against the seat 11*d*, as shown in broken lines in FIG. 3.

The armatures 11 and 13 are produced from a ferromagnetic material, for example from steel.

At least one coil 14 is borne by the external armature 11 this coil being housed in the annular volume B made between the two armatures 13 and 11. More precisely, this volume B is limited by the external extension of this surface, and by the internal surface of the external armature 11.

A main magnetic circuit, of which a flux line fp is shown schematically in FIG. 3, is formed between the external armature 11 and the moving armature 13. This main magnetic circuit comprises a constant portion of main air gap between the moving armature 13 and the flange 11*c* and the variable portion of main air gap m between the seat 11*d* and the moving armature 13. As shown in FIG. 1, the flux lines are closed by the moving armature 13 and the external armature 11.

A secondary magnetic circuit of which the reluctance is variable during operation between a minimum and a maximum, this variation being staggered relative to that of the reluctance of the main magnetic circuit, comprises at least one ferromagnetic element 12 of annular shape extending parallel to the axis A of the coil 14 (this axis A being common to the armatures 11 and 13), and being housed in the internal volume 18 of the coil 14. The ferro-magnetic element 12 can also be produced from steel.

According to the embodiment in FIG. 3, the ferromagnetic element 12 is constituted by a cylindrical sleeve of revolution 19 which the internal radius is equal to $r_i$ and of which the thickness is equal to h. The position of this sleeve 19 along the axis A of the coil 14 and of the actuator is defined by the distance a between the face of the sleeve 19 turned towards the flange 11*c* and the face of the moving armature 13, when it is at rest, turned towards the seat 11*d*. If the distance between the other extreme face of the sleeve 19 and the above-mentioned face of the moving armature 13 at rest is designated by b it is seen that the axial length of the sleeve 19 is equal to b−a.

FIG. 3 shows schematically a line fs of the magnetic flux in the secondary circuit when the moving armature 13 is in the rest position (shown in broken lines in FIG. 3) that is to say when this armature is remote from the maximum of the seat 11*d*. This secondary magnetic circuit corresponds to the following flux path: moving armature 13, constant annular air gap k, external armature 11, constant air gap between the seat 11*d* and the sleeve 19, and variable air gap between the sleeve 19 and the moving armature 13.

Figure 4:
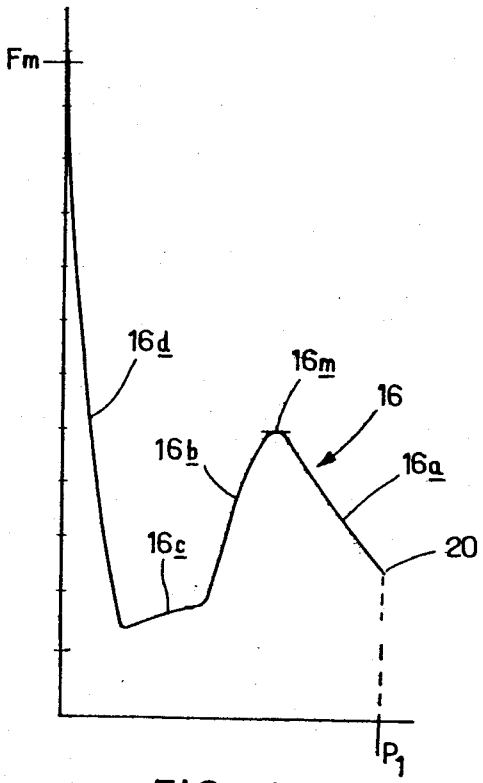
FIG. 4 shows the curve of the variation in the control force supplied by the actuator in FIG. 3 as a function of the stroke.

If a current of constant intensity is caused to circulate in the coil 14, the force of attraction exerted by the external armature 11 on the moving armature 13 varies as shown in FIG. 4.

In FIG. 4, the force acting on the moving armature 13 has been shown as ordinate and the length of the variable air gap m between the seat 11*d* and face opposing the moving armature 13 as abscissa. The length of this air gap m is at a maximum for the rest position $P_1$. On the axis of the abscissae in FIG. 4, the point $P_1$ corresponds to the maximum air gap.

In the position $P_2$, that is to say when the moving armature 13 rests against the seat 11*d*, the air gap m is zero, corresponding to the ordinate axis in FIG. 4.

The maximum value of the force exerted on the moving armature 13 is obviously obtained for this zero value of the main air gap m.

The curve 16 in FIG. 4 has a "saddle-back" shape. When departing from the point 20 corresponding to the abscissa $P_1$, the curve 16 has a first zone 16*a* for which the force increases and the air gap decreases. The curve 16 passes through the maximum 16*m* then has a zone 16*b* for which the force acting on the moving armature 13 diminishes. The curve 16 then has a zone 16*c* substantially constituting a lower threshold. This threshold 16*c* is followed by a zone 16*d* for which the force increases again while the air gap diminishes. The force attains its theoretical maximum value $F_m$ for the air gap zero.

If the peak 16*m* is to be shifted approximately parallel to the abscissa, it is sufficient to alter the parameter a defined above, without altering the parameter b. Modification of a is obtained by modifying the length of the sleeve 19 without modifying the axial position of the end of this sleeve turned towards the seat 11*d*.

If a increases, the peak 16*m* shifts towards the left according the illustration in FIG. 4, whereas, if a diminishes, the peak 16*m* shifts to the right.

Furthermore, if the length b−a of the sleeve 19 increases, a remaining constant, the ordinate of the peak 16*m* increases whereas the mean ordinate of the hollow 16*c* diminishes. The reverse applies if b−a diminishes.

If a and b−a are modified simultaneously, the result of all these modifications is substantially equal to the sum of the results of the individual modifications due to the change of a and of b−a.

If a diminishes, the difference in the abscissae between the peak 16*m* and the center of the hollow 16*c* increases and, moreover, the length of the pseudo threshold 16*c*, that is to say the difference of the abscissa between the ends of the base of the hollow constituted by the zone 16*e* increases.

The greater the distance b increases, the greater the force Fm obtained for the zero air gap diminishes.

The thickness h of the sleeve 19 also has an influence.

The more the thickness h decreases, the greater the difference between the ordinate of the peak 16*m* and the mean ordinate of the hollow zone 16*c* decreases. More precisely, if the thickness h decreases, the ordinate of the peak 16*m* of the hump decreases.

The curve 16 can thus be linearised and a portion of this curve can be rendered substantially parallel to the abcissa axis by reducing the thickness of h of the sleeve 19 sufficiently.

The effect of reducing the thickness h is similar to that obtained by reducing the difference b−a.

The sleeve 19 is held by the turns of the coil 14 which fills the annular space B. If necessary, the sleeve 19 can be embedded somehow in the coil 14, that is to say on either side axially of the sleeve 19, the radial thickness of the coil 14 is greater (and therefore comprises a greater number of turns) than just above the sleeve 19, as shown in FIG. 3.

If the coil 14 comprises several juxtaposed windings, the number of ampere turns of these windings can be selected at random without the axial position of the sleeve 19 having to be considered since the volume afforded for housing these ampere turns does not depend on said axial position of the sleeve 19.

The simplicity of installation and of design of the electromagnetic actuator comprising the sleeve 19 is clearly revealed.

A sleeve with a trucated external radial surface could be used instead of a cylindrical sleeve 19.

Figure 5:
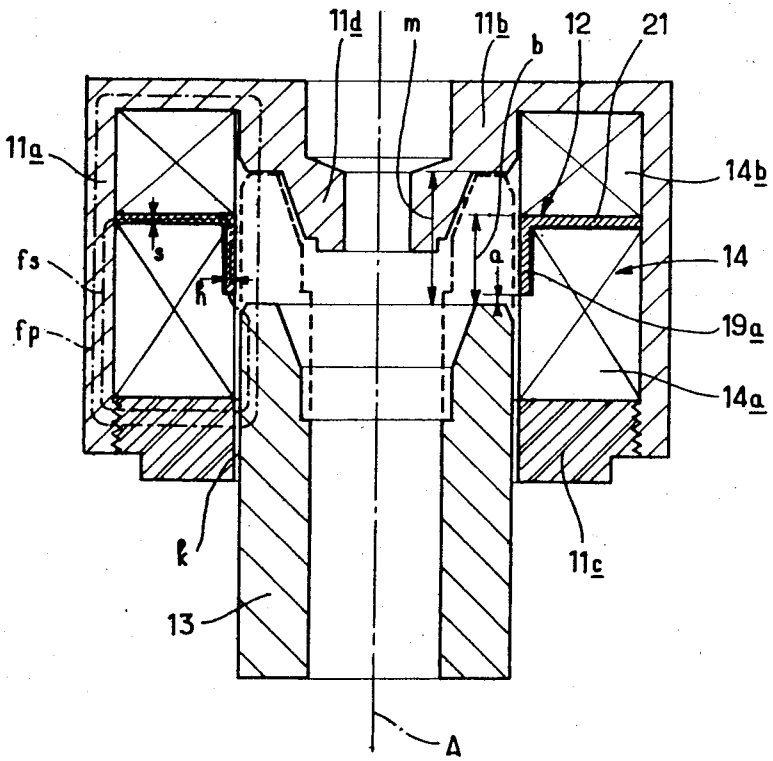
FIG. 5 shows another embodiment of an actuator according to the invention in an axial section.

FIG. 5 shows an alternative embodiment in which the annular ferromagnetic element 12 comprises a cylindrical sleeve of revolution 19*a* integral with a crown 21 of which the mean plane is orthogonal to the axis A and centred on said axis A and which extends radially to the internal surface of the external armature 11. The coil 14 comprises at least two windings 14*a*, 14*b* provided on either side of the crown 21. The element 12 can again be held by the turns of the one of the coils 14*a* according to the illustration in FIG. 5 inside which the sleeve 19*a* is engaged.

The elements in FIG. 5 which are similar or fulfill similar roles to the elements already described with reference to FIG. 3 have been designated by the same reference numerals or letters to save repeating the description thereof.

The section through a diametral plane of the element 12 is L shaped or square, as shown in FIG. 5. The crown 21 is integral with the end of the sleeve 19*a* remote from the flange 11*c*.

The lines of flux fs of the secondary circuit as shown in FIG. 5, pass through the branch formed by the crown 21 then through the variable air gap between the front end of this sleeve 19*a* turned towards the flange 11*c* and the moving armature 13.

It can be observed that the presence of the crown 21 limits the volumes afforded to the windings 14*a* and 14*b* on either side of this crown and thus determines the maximum number of ampere turns possible for these windings.

Figure 6:
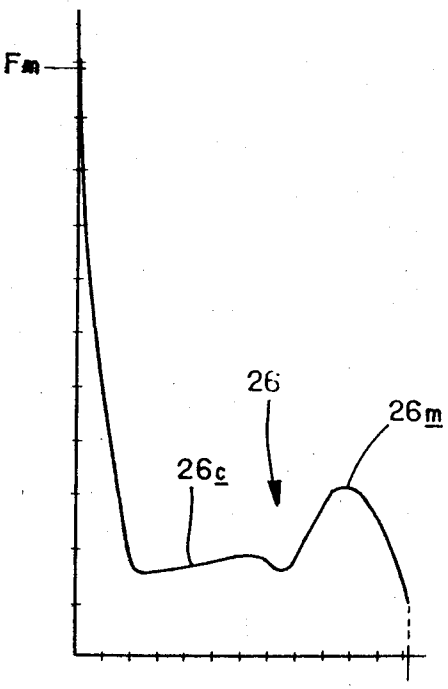
FIG. 6 shows the curve of the variation in the force as a function of the stroke supplied by the actuator in FIG. 5.

If a current of constant intensity is caused to circulate in the windings 14*a*, 14*b* the force exerted on the moving armature 13 varies along the curve 26 in FIG. 6 as a function of the length of the main air gap m. The same values as in FIG. 4 have been plotted as ordinate and abscissa in FIG. 6.

The curve in FIG. 6 is designated by 26 and the various points or zones on this curve similar to points or zones on the curve 16 in FIG. 4 are designated by reference numerals having the same subscript as the references in Figure. The description of these zones or of these points will not be repeated.

It can be seen that the range of the hollow 26*c* along the axis of the abscissae is greater. The parameters a and b and the thickness h have the same meaning for the sleeve 19*a* as in FIG. 3 for the sleeve 19.

The thickness of the crown 21 has been designated by s.

For a constant thickness s, if the thickness h of the sleeve 19*a* is diminished, the horizontality of the curve 26 is accentuated. That is to say the ordinate of the peak 26*m* is reduced and the mean ordinate of the hollow 26*c* is increased, as in FIG. 3.

If the difference b−a is increased, with the square configuration of the element 12 shown in FIG. 5, the ordinate of the peak 26*m* is also reduced and the mean ordinate of the hollow 26*c* is increased. This result is the reverse of that obtained with the configuration in FIG. 3 with an increase in the difference b−a.

If the ratio h/s is considered, that is to say the ratio of the thickness of the cylindrical sleeve 19*a* to the thickness of the crown 21, it can be said that the smaller this ratio h/s the more the curve 26 is flattened (reduction of the difference between the ordinates of the peak 26*m* and the mean point of the hollow 26*c*).

It should be noted that the sleeve 19*a* can be extended axially beyond the crown 21 in the direction of the seat 11*d*. In this case, the section through a diametral plane of the entire element 12 would be substantially T shaped.

Figure 7:
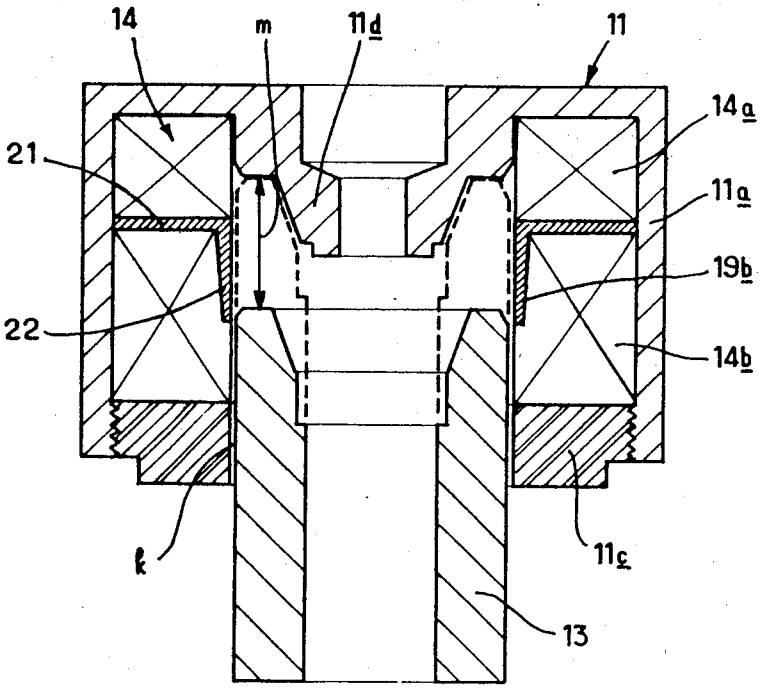
FIG. 7 is a diagram of yet another embodiment of an actuator according to the invention.

FIG. 7 shows another alternative embodiment of the element 12.

The crown 21 from FIG. 5 is again shown integral with a sleeve 19*b* of which the external surface 22 is truncated, the diameter of this surface 22 diminishing progressively when moving away from the disc 21 in the direction of the flange 11*c*.

Figure 8:
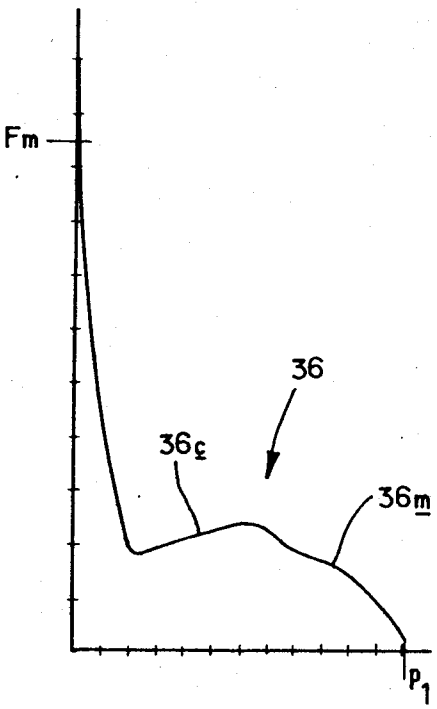
FIG. 8 shows the curve of the variation in the force as a function of the stroke obtained with the actuator shown in FIG. 7.

The curve 36 shown in FIG. 8, which illustrates the variation in the force acting on the moving armature 13 as a function of the length of main air gap m for the embodiment in FIG. 7 is much flatter than in FIG. 8. In the practical case shown in FIG. 6, the peak 36*m* has an ordinate slightly smaller than the mean ordinate of the hollow 36*c*.

It should be noted that the inclination of the truncated external surface 22 could take place in the reverse direction, that is to say that the diameter of the surface would increase progressively on moving away from the crown 21 towards the flange 11*c*. In this case, the ordinate of the peak 36*m* would tend to increase relative to the mean ordinate of the hollow 36*c*.

The cross section of the ferromagnetic element through a diametral plane could have a different shape, for example, the shape of a T. In this case, relative to the L section in FIGS. 5 and 7, the T section would have an extension of the sleeve 19*a* or 19*b* on the other side of the crown 21. In other words, if the element has a T-shaped cross section, the sleeve passes through the circular crown.

In all the embodiments considered, it is found that the presence of a sleeve such as 19, 19*a* or 19*b* permits simple assembly of the element 12 which is held by means of the turns of the windings. There are numerous possible ways of adapting the curves 16, 26 or 36 to the problem to be solved by altering the various characteristic parameters of the sleeve 19, 19*a* or 19*b*.

This sleeve is situated between the base 11*b* and the flange 11*c* in the axial direction. Its internal radius $r_i$ is greater than the external radius of the moving armature 13 by a value close to that of the air gap k in such a way that the armature 13, during its stroke towards the seat 11*d*, can engage in the sleeve 19, 19*a*, 19*b*, as shown in FIGS. 3, 5, and 7. When the moving armature 13 is in the rest position, it is located completely outside the sleeve 19, 19*a* or 19*b*, in the axial direction, the variable air gap between the sleeve 19, 19*a* or 19*b* and the moving armature 13 thus having its maximum value a. During the stroke of the armature 13 towards the seat 11*d*, the variable air gap of the secondary magnetic circuit decreases and substantially reaches its minimum when the armature 13 penetrates into the sleeve 19, 19*a*, or 19*b*. The reluctance of the secondary magnetic circuit therefore assumes its minimum value before that of the main magnetic circuit.

What we claim is:

1. An electromagnetic actuator comprising:

an outer armature having a cylindrical shape and comprising a base;

an inner armature positioned substantially along the axis of the outer armature, the two armatures being moveable relative to each other, during a stroke of the actuator, between a first position in which the movable armature is at a maximum distance from the base, and a second position in which the moveable armature is located at the end of the stroke toward the base;

said inner and outer armatures defining a principal magnetic circuit having an air gap comprised of a variable portion between the inner armature and the base of the outer armature, and an essentially constant portion between the two armatures;

the reluctance of said principal circuit having a maximum value when the inner armature is at the maximum distance from the base of the outer armature, and a minimum value when the inner armature is located at the end of the stroke toward the base of the outer armature, a ferro-magnetic separator including a radial portion within the outer armature, said magnetic separator establishing a secondary magnetic circuit in which lines of flux pass through the radial portion of the magnetic separator, the magnetic separator cooperating with the movable armature to establish a variable air gap to cause a variation of reluctance of the secondary magnetic circuit which is shifted along the stroke with respect to the variation of reluctance of the principal magnetic circuit, the variations of reluctance of the principal and secondary magnetic circuits during the course of an operating stroke of the actuator being monotone variations in the same direction, and first and second coil elements within the outer armature, and wherein the magnetic separator has the form of an annular washer of substantially constant thickness e, and when the air gap of the main magnetic circuit is at a minimum, the variable portion of the air gap is constituted by a single cylindrical space of substantially constant width E defined by the separator.

2. An actuator as claimed in claim 1, in which, the effort supplied by the moving element varies as a function of the stroke along the "saddle-back" curve, the external armature has a substantially constant wall thickness H and a mean diameter $\phi_e$, the internal rim of the separator is a circle on the same axis as the cylindrical wall of the external armature, and has a diameter $\phi_1$, and the ratio $e\phi_1$:$H\phi_e$, is in the range from 0.18 to 0.45.

3. An actuator as claimed in claim 1, in which, the effort supplied by the moving element varies as a function of the stroke along a "saddle-back" curve, the length of the stroke between the positions where the air gap of the main magnetic circuit is a maximum or minimum is designated by D, and the ratio E:D is in the range from 0.04 to 0.17.

4. An actuator as claimed in claim 1, in which the effort supplied by the moving element varies as a function of the stroke along a "saddle-back" curve, the length of the stroke between the positions where the air gap of the main magnetic circuit is a maximum or minimum is designated by D, the distance between the separator and constant portion of the air gap of the main magnetic circuit is designated by x, the distance between the front face of the internal armature which is opposed to the base of the external armature and the constant portion of the air gap of the main magnetic circuit when the air gap is at a maximum, is designated by $x_o$, and the ratio $x-x_o$:D is close to 0.37.

5. An actuator as claimed in claim 1, in which, the effort supplied by the moving element remains substantially constant along a large portion of the stroke, the thickness of the cylindrical wall of the external armature being substantially constant and designated by H, the mean diameter of said cylindrical wall of the external armature being designated by $\phi_e$, the diameter of an internal rim of the separator by $\phi_1$, said internal rim being a circle having the same axis as the cylindrical wall of the external armature, and the ratio $e\phi_1$:$H\phi_e$ is in the range from 0.08 to 0.18.

6. An actuator as claimed in claim 1, in which, the effort supplied by the moving element remains substantially constant along a large proportion of the stroke, D represents the length of stroke between the positions where the air gap of the main magnetic circuit is at a maximum and a minimum, and the ratio E:D is in the range from 0.17 to 0.43.

7. An actuator as claimed in claim 1, in which, the effort supplied by the moving element remains substantially constant along a large proportion of the stroke, D represents the length of stroke between the positions where the air gap of the main magnetic circuit is at a maximum and a minimum, the distance between the separator and the constant portion of the air gap of the main magnetic circuit is designated by x, the distance between the front face of the internal armature opposed to the base of the external armature and the constant portion of the air gap of the main magnetic circuit when said air gap is at a maximum is designated by $x_o$, and the ratio $x-x_o$:D is in the range from 0.15 to 0.60.

* * * * *